US006450463B1

(12) United States Patent
Mc Cord et al.

(10) Patent No.: US 6,450,463 B1
(45) Date of Patent: Sep. 17, 2002

(54) SUPPORT AND POSITIONING STRUCTURE FOR GAS CYCLINDERS

(75) Inventors: Anthony Mc Cord; François Quentin, both of Paris (FR)

(73) Assignee: L'Air Liquide, Societe Anonyme a Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 09/639,338

(22) Filed: Aug. 16, 2000

(30) Foreign Application Priority Data

Oct. 7, 1999 (FR) ..... 99 12497

(51) Int. Cl.[7] ..... A47G 23/02
(52) U.S. Cl. ..... 248/146; 248/154; 248/312
(58) Field of Search ..... 248/154, 146, 248/314, 230.1, 312, 312.1

(56) References Cited

U.S. PATENT DOCUMENTS 2,017,319 A * 10/1935 McMullen ..... 248/312
2,278,232 A * 3/1942 Anderson ..... 211/8
3,872,868 A * 3/1975 Kline ..... 604/403
5,210,901 A 5/1993 Cooper
5,853,154 A 12/1998 Ashley
6,220,557 B1 * 4/2001 Ziaylek et al. ..... 248/316.1

FOREIGN PATENT DOCUMENTS

FR 2 570 339 3/1986
WO 91 18637 12/1991

* cited by examiner

*Primary Examiner*—Ramon O. Ramirez
(74) *Attorney, Agent, or Firm*—Young & Thompson

(57) ABSTRACT

A support and positioning structure includes an upper cradle (3) of V shape or C shape opening outwardly and a base (1) with an abutment (6) projecting upwardly and a support surface (5) inclined relative to the horizontal and extending over a distance less than the nominal diameter of a cylinder (7). The cylinder (7) is thus easily and correctly positioned in a stable fashion in a predetermined place and can be easily withdrawn to be moved.

14 Claims, 1 Drawing Sheet

SUPPORT AND POSITIONING STRUCTURE FOR GAS CYCLINDERS

BACKGROUND OF THE INVENTION

Corresponds to French Application No. 99 12497 filed on Oct. 7, 1999, the disclosure of which is incorporated herein by reference.

The present invention relates to support and positioning structures for gas cylinders, particularly large industrial gas cylinders of the type B40 or B50.

Gas cylinders are generally stored, temporarily or for a certain time, by being vertically positioned on their base after having been rolled to their approximate positioning site. Raising these large cylinders requires exerting on their cap a large tractive effort to free one end of the base from the support surface and to permit rolling the cylinder.

SUMMARY OF THE INVENTION

The present invention has for its object to provide a support and positioning structure for gas cylinders, guaranteeing a correct and reproducible positioning of the cylinders and greatly facilitating their handling, both for positioning and removal.

To do this, according to one characteristic of the invention, the support and positioning structure comprises a base and an upper cradle, the base forming an inclined surface relative to the horizontal connecting to an abutment forming an upward projection.

According to other characteristics of the invention:

- the extension of the inclined surface from the abutment is less than the diameter of the cylinder, and typically greater than the radius of the cylinder
- the cradle has a V shape or a C shape that opens outwardly.

BRIEF DESCRIPTION OF THE DRAWINGS

Other characteristics and advantages of the invention will become apparent from the following description of embodiments, given by way of illustration but in no way limiting, with respect to the accompanying drawings, in which.

DESCRIPTION OF THE PREFERRED EMBODIMENTS

Figure 1:
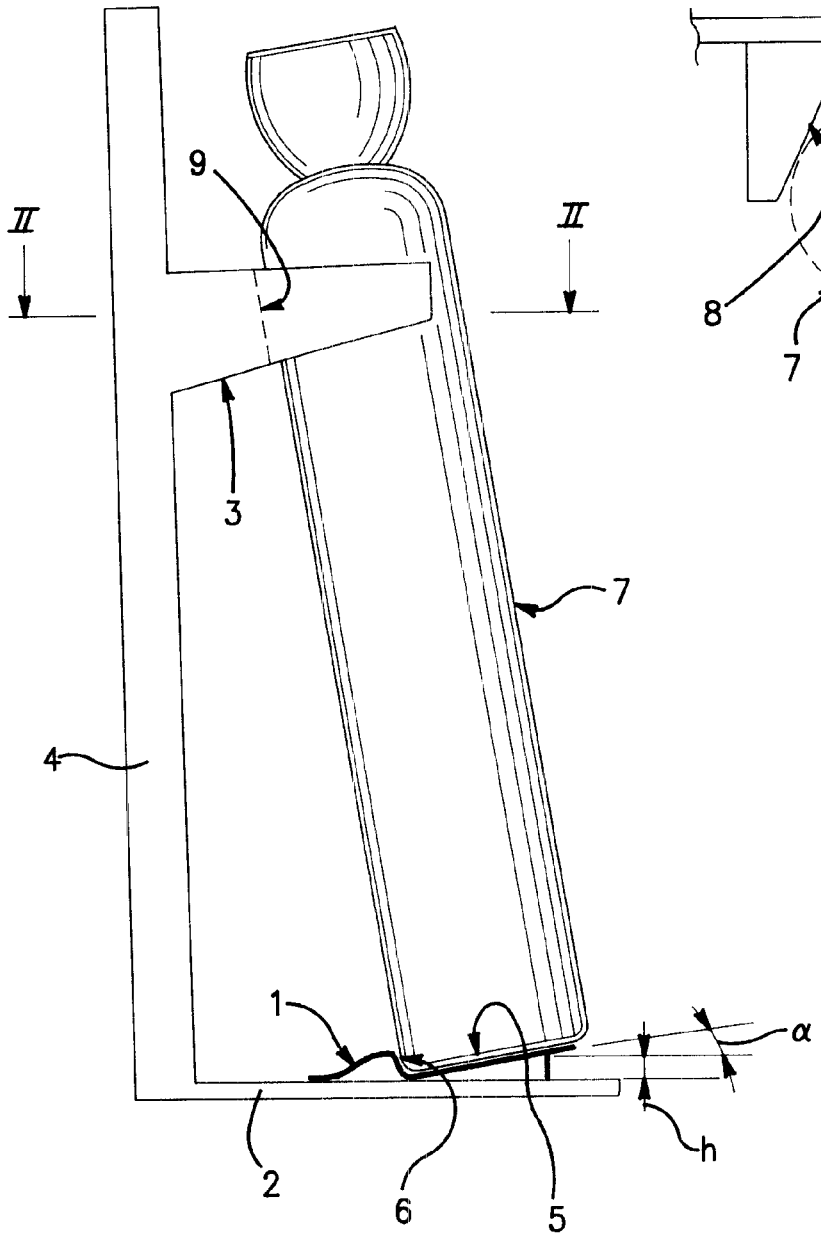
FIG. 1 is a schematic elevational view of an embodiment of a support and positioning structure for gas cylinders, accord he invention.

In the embodiment shown by way of example in the figures, the support and positioning structure comprises essentially a base 1 mounted on a base surface 2 and an upper cradle 3 mounted in line with the base 1 on a vertical structure 4 to which is also connected the base surface 2. The vertical distance between the cradle 3 and the base 1 corresponds at most to 75% of the height of cylinder 7, typically between 80 and 120 cm for standard industrial gas cylinders.

According to one aspect of the invention, the base 1 forms a support surface 5 inclined relative to the horizontal at an angle α opening in the direction opposite the structure 4 and comprised typically between 5 and 10°. The surface 5 is connected, at its lower portion, on the side of the surface 4, to an abutment 6 which projects slightly upwardly. The support surface 5 extends forwardly, from the abutment 6, by a distance less than the nominal diameter of a cylinder 7 and greater than half the diameter of this cylinder, namely typically between 10 and 25 cm.

Figure 2:
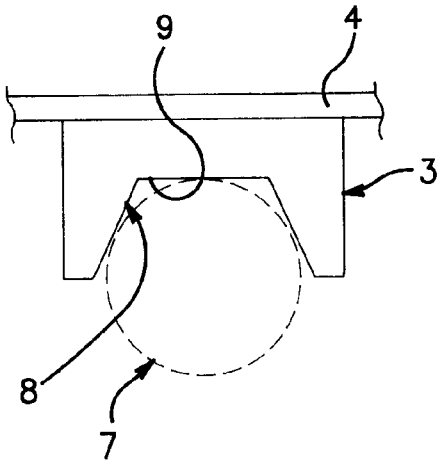
FIG. 2 is a fragmentary cross-sectional view on the line II—II in FIG. 1.

The cradle 3 preferably has, seen from above, as in FIG. 2, a V shape or C shape opening outwardly, in this case forwardly relative to the support structure 4, thereby defining an internal volume 8 for reception of an upper portion of a body of a cylinder. This volume 8 forms internally at least one surface or rear bearing ridge for a generatrix of the body of the cylinder 7. This bearing surface 9 is offset toward the structure 4 such that, as shown in FIG. 1, the cylinder 7 in position in the support and positioning structure will be inclined relative to the vertical by the same angle α as the support surface 5 relative to the horizontal, which is to say that the surface 9 is located in the vertical inclined plane of the abutment 6, or tangent to this plane.

With the arrangement according to the invention, the base 5 forms a small front step of a height h, typically not more than 4 cm, which does not interfere with the emplacement on the base 1 of the cylinder rolled toward its storage position. Once positioned on the surface 5, the cylinder is inclined in a direction toward the surface 4. Its base will automatically be in abutment against the abutment 6 and its upper portion will be disposed in the cradle 3 in a position which is fixed in space and perfectly defined by the cradle, without the risk of tipping. This imposed correct positioning is of particular interest in storage and distribution installations for cylinders comprising optical or electromagnetic identification means for the interposed individual cylinders and/or unlockable retention systems for the cylinders. As a modification, the abutment 6 could be constituted by the rear portion of a C shaped or D shaped cradle opening forwardly in the manner of the upper cradle 3.

According to one aspect of the invention, the existence of the step of height h and of the overhanging position of the base of the cylinder relative to this surface 5, permits easily, with a small tractive force, swinging the cylinder 7 vertically to remove it from the cradle 3 and to move it toward another place.

The base 1 can be constituted by a machined or molded metallic block to constitute the dihedral 5, 6. Preferably, as shown in FIG. 1, the base 1 is in the form of a metallic sheet fixed at its ends, on opposite sides of the dihedral 5, 6 on the base 2. Similarly, the cradle 3 can be made all or in part of bent sheet metal.

The support and positioning structure according to the invention can be an individual structure for a single cylinder, transportable and positioned in any site. Preferably, it can be duplicated to constitute a rack with multiple adjacent pairs of cradles and bases mounted on a common metallic support structure 4, 2, if desired associated with or connected to a wall of a site for storage and distribution of gas cylinders with free or controlled access. In this case, the vertical structure is preferably constituted by one of the walls of the site, and the base 1 constituted by a profile extending laterally, parallel to the wall and fixed in position on the floor of the site, forming the base surface 2.

What is claimed is:

1. A support and positioning structure for a gas cylinder, comprising at least a pair of a base portion and an upper cradle interconnected by a vertical structure, said base portion having an upper surface for supporting a bottom of a cylinder, said upper surface being inclined at an angle relative to horizontal and descending towards said vertical structure and connecting into an upwardly extending abutment.

2. The structure according to claim 1, wherein an extent of said upper surface from said abutment is less than a diameter of the cylinder.

3. The structure according to claim 2, wherein an extent of said upper surface from said abutment is greater than a radius of the cylinder.

4. The structure according to claim 1, wherein said abutment and said upper surface are constituted by a sheet of metal bent to form a dihedral.

5. The structure according to claim 1, wherein said upper cradle has one of a V shape and a C shape that opens outwardly.

6. The structure according to claim 5, wherein said upper cradle has at least one bearing surface inclined relative to the vertical and substantially parallel to a surface of said abutment on which the cylinder rests.

7. The structure according to claim 1 that it is transportable.

8. The structure according to claim 1, comprising at least two adjacent said pairs.

9. The structure according to claim 1 that is fixed against a wall of a site, said vertical structure contacting the wall.

10. The structure of claim 1, wherein said base portion is flat and perpendicular to said vertical structure, except at said upper surface and said abutment.

11. The structure of claim 1, wherein said abutment is spaced from said vertical structure by a distance that defines an inclination of the cylinder.

12. The structure of claim 1, wherein said abutment and said upper surface comprise a saw tooth pattern.

13. A support for a cylinder, comprising:

an upper cradle and a base portion extending from an upright member;

said base portion comprising a flat plate having thereon a first surface that is inclined relative to horizontal when said flat plate is horizontal and a projecting abutment between said first surface and the upright member, said abutment being spaced from the upright member by a distance that defines an inclination of a cylinder whose bottom is on said first surface and whose side is on said upper cradle, said abutment having a second surface that is inclined relative to vertical and that bears part of a weight of the cylinder when the bottom of the cylinder is on said first surface; and said upper cradle having a third surface on which the side of the cylinder rests and that bears a part of the weight of the cylinder when the bottom of the cylinder in on said first surface, said third surface being parallel to said second surface.

14. The support of claim 13, wherein said first and second surfaces are a sheet of bent metal.

* * * * *